US011351410B2

(12) United States Patent
Person

(10) Patent No.: US 11,351,410 B2
(45) Date of Patent: Jun. 7, 2022

(54) FUNCTIONAL CORE TRAINING DEVICE FOR THE MUSCULAR AND MYOFASCIAL SYSTEMS IN THE BODY

(71) Applicant: Todd Anthony Person, Los Angeles, CA (US)

(72) Inventor: Todd Anthony Person, Los Angeles, CA (US)

( * ) Notice: Subject to any disclaimer, the term of this patent is extended or adjusted under 35 U.S.C. 154(b) by 552 days.

(21) Appl. No.: 16/331,087

(22) PCT Filed: Dec. 21, 2018

(86) PCT No.: PCT/US2018/067394

§ 371 (c)(1),
(2) Date: Mar. 6, 2019

(87) PCT Pub. No.: WO2019/126810

PCT Pub. Date: Jun. 27, 2019

(65) Prior Publication Data

US 2021/0331030 A1 Oct. 28, 2021

Related U.S. Application Data

(60) Provisional application No. 62/609,335, filed on Dec. 21, 2017.

(51) Int. Cl.

| | |
|---|---|
| ***A63B 21/068*** | (2006.01) |
| ***A63B 22/06*** | (2006.01) |
| ***A63B 22/20*** | (2006.01) |
| ***A63B 22/00*** | (2006.01) |

(52) U.S. Cl.

CPC ..... *A63B 22/0005* (2015.10); *A63B 21/068* (2013.01); *A63B 22/0605* (2013.01); *A63B 22/20* (2013.01); *A63B 2208/0295* (2013.01)

(58) Field of Classification Search

CPC ..... A63B 22/0002; A63B 22/0005; A63B 22/0048; A63B 22/06; A63B 22/0605;
(Continued)

(56) References Cited

U.S. PATENT DOCUMENTS

| | | | | |
|---|---|---|---|---|
| 5,643,162 | A * | 7/1997 | Landers | A63B 21/4035 482/131 |
| 8,088,052 | B1 | 1/2012 | Sprague | |
| 9,180,335 | B1 * | 11/2015 | Wu | A63B 23/0211 |
| D752,161 | S * | 3/2016 | Wartenbergh | D21/691 |
| 9,844,696 | B2 * | 12/2017 | Anderson | A43B 3/00 |

(Continued)

OTHER PUBLICATIONS

PCT/US2018/067394. International Search Report and Written Opinion (dated Apr. 18, 2019).

*Primary Examiner* — Nyca T Nguyen
*Assistant Examiner* — Zachary T Moore
(74) *Attorney, Agent, or Firm* — Loza & Loza, LLP; Heidi Eisenhut

(57) ABSTRACT

A muscle strengthening system is provided having a functional core endurance training device and a pair of rolling blocks for supporting the functional core endurance training device. Each rolling block in the pair of rolling blocks includes an elongated opening for receiving a wheel of the functional core endurance training device. Additionally, each rolling block in the pair of rolling blocks includes a pair of rollers, a stabilizer and a bumper guard for grounding the surface of the wheels of the functional core endurance training device allowing the wheels to spin with increased intensity. Optionally, an individual may utilize a stationary foot pedestal or a wheeled foot pedestal that provides for both the strengthening of the muscles of the individual while simultaneously stimulating an endurance building effect on the muscular and fascial systems of the body, all of which is achieved with minimal to no impact/pounding on the joints.

14 Claims, 11 Drawing Sheets

(58) Field of Classification Search
CPC ..... A63B 22/0611; A63B 22/0635; A63B 22/0694; A63B 22/14; A63B 22/20; A63B 2022/0033; A63B 2022/0035; A63B 2022/0043; A63B 2022/0082; A63B 21/0004; A63B 21/00047; A63B 21/00058; A63B 21/00069; A63B 21/000185; A63B 21/0608; A63B 21/22; A63B 21/222; A63B 21/4019; A63B 21/4023; A63B 21/4049; A63B 3/00; A63B 1/00
See application file for complete search history.

(56) References Cited

U.S. PATENT DOCUMENTS

| | | | | |
|---|---|---|---|---|
| 2006/0252607 | A1* | 11/2006 | Holloway | A63B 21/4049 482/62 |
| 2007/0060453 | A1* | 3/2007 | Papadopoulos | A63B 69/16 482/61 |
| 2011/0287901 | A1* | 11/2011 | Wan | A63B 22/0023 482/57 |
| 2013/0217549 | A1* | 8/2013 | Marji | A63B 21/4035 482/132 |
| 2013/0252790 | A1* | 9/2013 | Sutton | A63B 23/03541 482/131 |
| 2014/0371036 | A1 | 12/2014 | Ellis | |
| 2017/0189778 | A1* | 7/2017 | Kimura | B62H 7/00 |
| 2019/0160327 | A1* | 5/2019 | Wilson | A63B 1/005 |
| 2020/0261765 | A1* | 8/2020 | Jones | A63B 22/0046 |

* cited by examiner

FUNCTIONAL CORE TRAINING DEVICE FOR THE MUSCULAR AND MYOFASCIAL SYSTEMS IN THE BODY

CLAIM OF PRIORITY

The present application for patent claims priority to U.S. Provisional Application No. 62/609,335 entitled "FUNCTIONAL CORE TRAINING DEVICE FOR THE MUSCULAR AND MYOFASCIAL SYSTEMS IN THE BODY", filed Dec. 21, 2017 and which is hereby expressly incorporated by reference herein.

FIELD

The present disclosure generally relates to a system for strengthening the muscles of an individual. The system may include a functional core endurance training device, a pair of rolling blocks and optionally a stationary foot pedestal or a wheeled foot pedestal that provides for both the strengthening of the muscles of an individual that allow for dynamic postural control while simultaneously stimulating an endurance building effect on the muscular and fascial systems of the body, all of which is achieved with minimal to no impact/pounding on the joints of the individual.

BACKGROUND

Strength describes or defines the ability to generate force, power defines how quickly a body can generate that force, while endurance is the length of time that the force can be generated. An athlete in training uses strength, power and endurance along with the core of the body to achieve pelvic neutral and keep the athletic into pelvic neutral. When the athlete fatigues the athlete goes out of pelvic neutral and into a default pelvic position which increases the risk of injury. Although it is referred to as core strength, an athlete staying in pelvic neutral is a matter of endurance and not strength despite it being referred to as core strength.

Upper body Ergometer's (UBE) have been a staple of physical therapy and fitness programs for decades. Traditional UBE's are used in sitting or standing positions and are designed specifically for non-weight bearing cardiovascular training and/or mild strengthening of deconditioned muscles of the upper extremities (UE). The traditional upper body ergometer (UBE)'s almost exclusively targets the prime movers of the upper extremities (UE) of the body (Triceps/Biceps/Deltoid/Teres Major/Pecs) and stimulates the cardiovascular system.

In view of the aforementioned problems, a system for strengthening muscles of an individual by stimulating the cardiovascular system of the body of the individual and targeting both upper extremity and lower extremity prime movers as well as all of the "core muscles" (Lats/Abs/Obliques/Psoas/Erectors) of the body.

Additionally, the system for strengthening muscles of the present disclosure comprises a functional core endurance training device, a pair of rolling blocks and optionally a stationary foot pedestal or a wheeled foot pedestal. This muscle strengthening system is the first UBE that allows a user to perform UE forward and reverse cycling movements in dynamic weight bearing positions, making it one of the most versatile and effective performance optimization devices on the market.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a system for strengthening muscles of an individual is provided comprising: a first rolling block having a first elongated opening; a second rolling block having a second elongated opening, the second rolling block secured to the first rolling block by a first elongated horizontal rod and a second elongated horizontal rod; a functional core endurance training device, comprising: an elongated rotating axle having a first hand grip and a second hand grip separated by a mid-section shaft; a first wheel rotatably secured to the first hand grip and received in the first elongated opening; and a second wheel rotatably secured to the second hand grip and received in the second elongated opening.

BRIEF DESCRIPTION OF THE DRAWINGS

Various features, nature, and advantages may become apparent from the detailed description set forth below when taken in conjunction with the drawings in which like reference characters identify correspondingly throughout.

DETAILED DESCRIPTION

Figure 1:
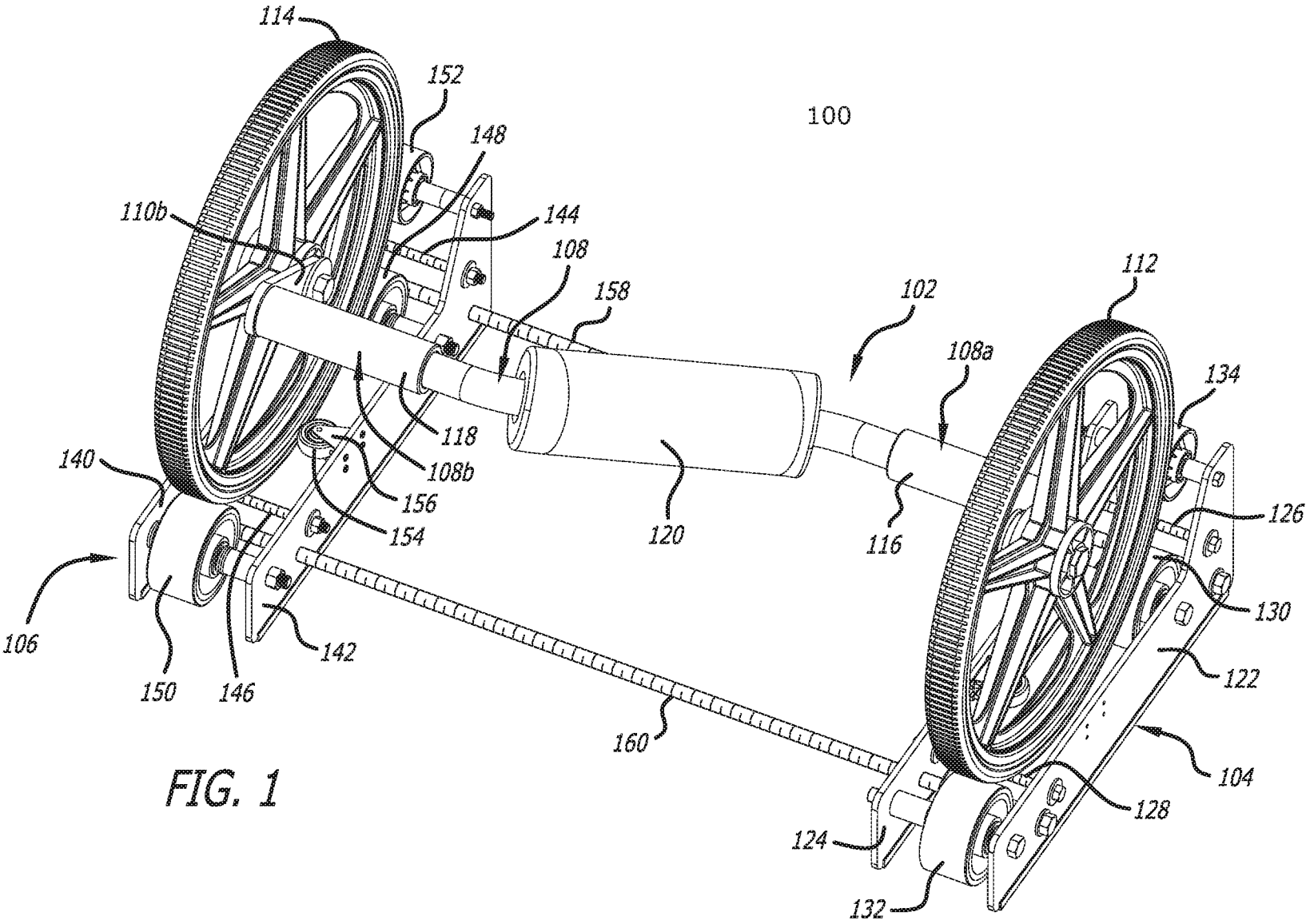
FIG. 1 illustrates a right rear perspective view of the muscle strengthening system of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

Overview

One feature of the present disclosure provides a muscle strengthening system. The system may include a functional core endurance training device and a pair of rolling blocks for supporting the functional core endurance training device. Each rolling block in the pair of rolling blocks includes an elongated opening for receiving a wheel of the functional core endurance training device. Additionally, each rolling block in the pair of rolling blocks includes a pair of rollers, a stabilizer and a bumper guard for grounding the surface of the wheels of the functional core endurance training device allowing the wheels to spin with increased intensity on the rolling blocks. Optionally, an individual may utilize a stationary foot pedestal or a wheeled foot pedestal that provides for both the strengthening of the muscles of the individual that allow for dynamic postural control while simultaneously stimulating an endurance building effect on the muscular and fascial systems of the body, all of which is achieved with minimal to no impact/pounding on the joints of the individual.

The unique ergonomic design of muscle strengthening system utilizes the functional core endurance training device and rolling blocks to create a novel training effect that can be described as functional core endurance training. Compared to the traditional upper body ergometer (UBE)'s, which almost exclusively targets the prime movers of the upper extremity (UE) (Triceps/Biceps/Deltoid/Teres Major/Pecs) and stimulates the cardiovascular system, the muscle strengthening system utilizes of the present disclosure targets both upper extremity and lower extremity prime movers as well as all of the "core muscles" (Lats/Abs/Obliques/Psoas/Erectors) of the body.

The muscle strengthening system of the present disclosure is the first training tool that specifically targets the "functional Lines" of Fascia (connective tissue) that run from and through the lower body to the upper body. These Functional Fascial Lines facilitate dynamic control during compound movements for sports, including but not limited to, running, jumping and throwing. As such, as discussed above the muscle strengthening system of the present disclosure provides both strengthening of the muscles that allow for dynamic postural control while simultaneously stimulating an endurance building effect on the muscular and fascial systems of the body all of which is achieved with minimal to no impact/pounding on the joints.

According to another feature, the muscle strengthening system of the present disclosure allows an individual, such as an athlete, to work the core body with movement while many of the traditional core exercises are static. In addition to the upper extremity movement, a wheeled foot pedestal can be utilized to try to maintain pelvic stability in an unstable environment. Instead of the wheeled foot pedestal, described in more detail below, a stationary foot pedestal, sissel pads, bosu balls, trx, etc. may be used.

In one practical application of the present disclosure, the individual may start on two stable surfaces meaning both feet are on the ground and then progress to one unstable surface, for example one foot on an unstable object such as wheeled foot pedestal. Next, the individual may progress to placing both fees on the wheeled foot pedestal.

Muscle Strengthening System—Functional Core Endurance Training Device

Figure 2:
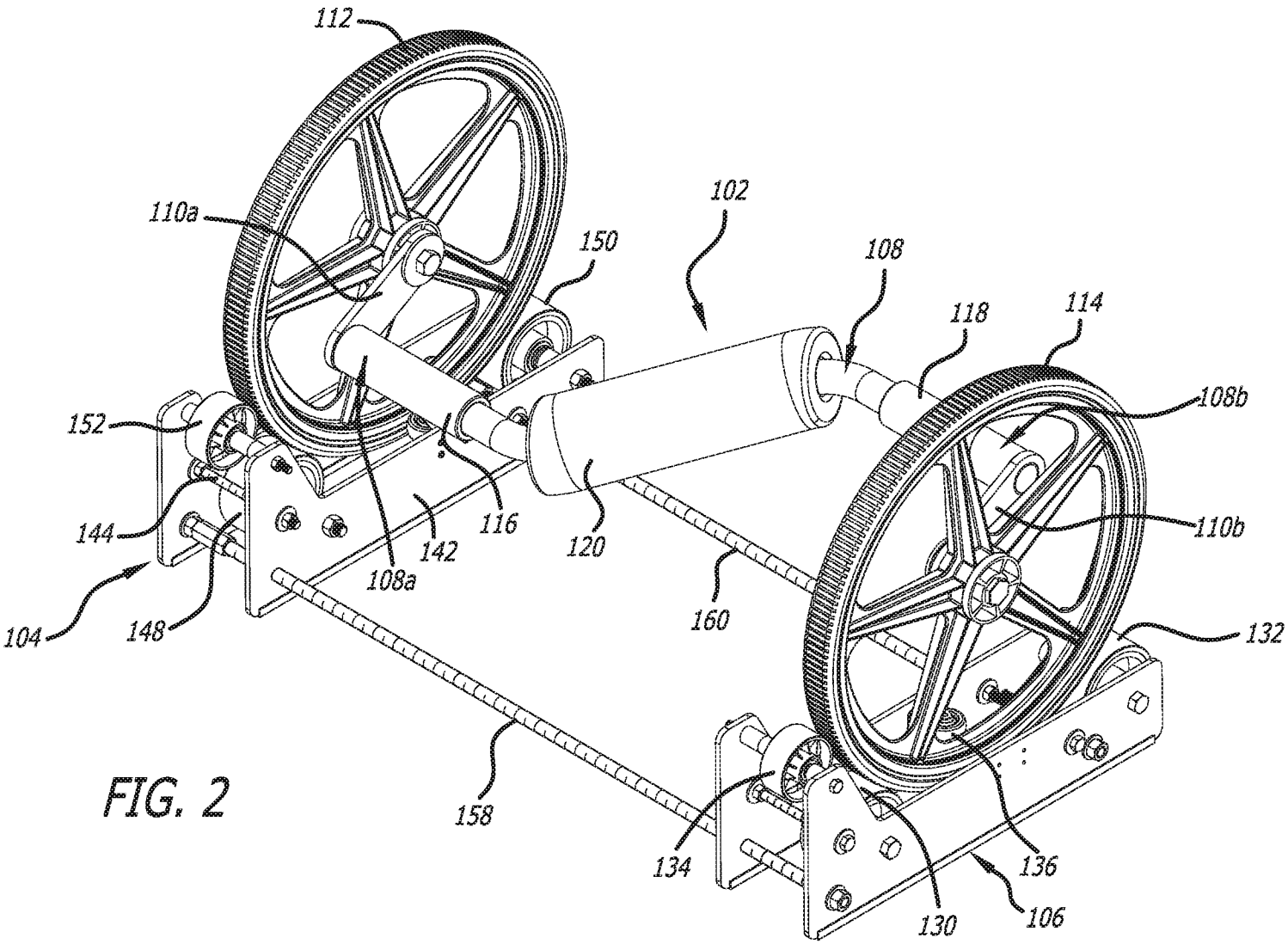
FIG. 2 illustrates a left front perspective view of the muscle strengthening system of the present disclosure.
Figure 3:
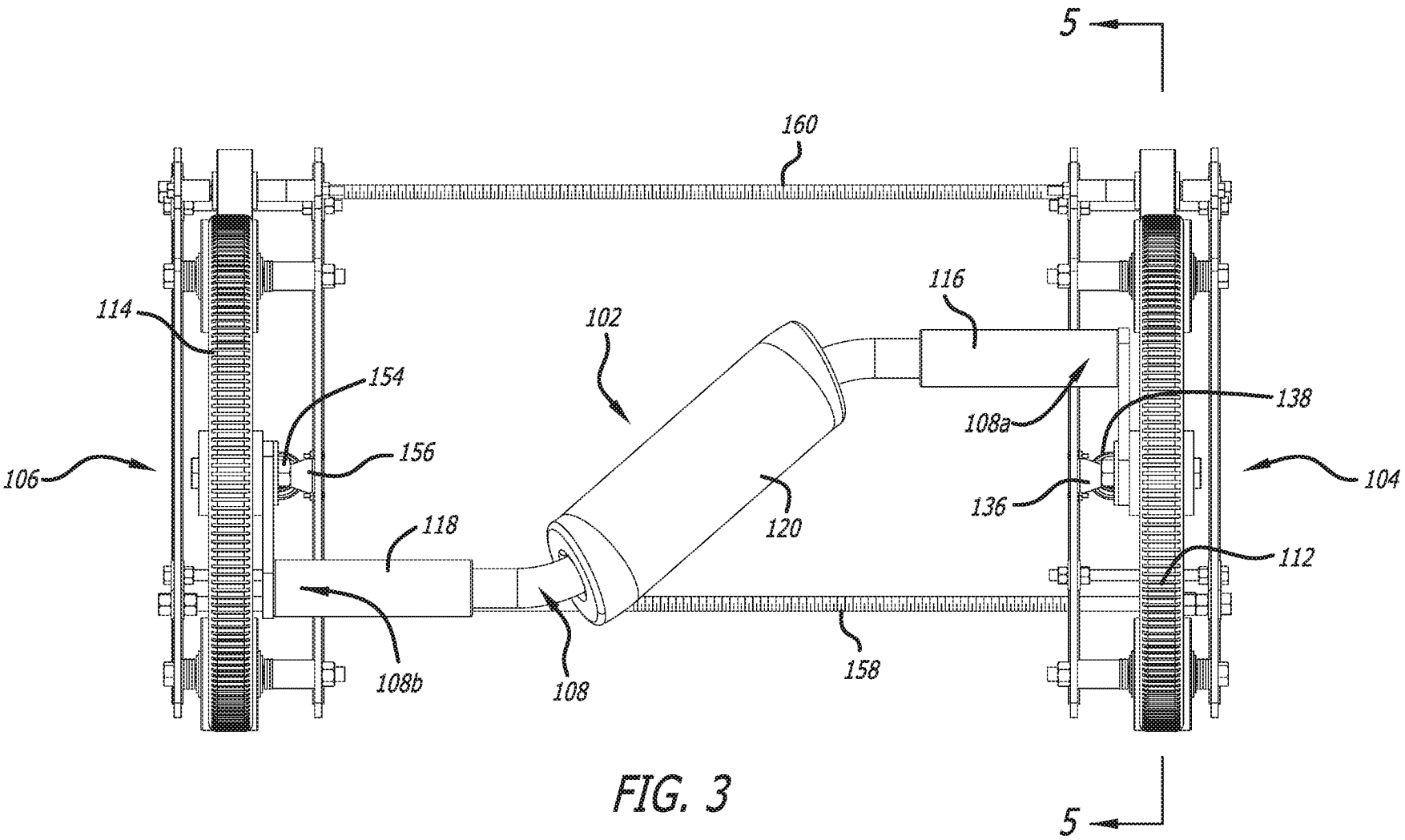
FIG. 3 illustrates a top plan view of the muscle strengthening system of FIG. 1.
Figure 4:
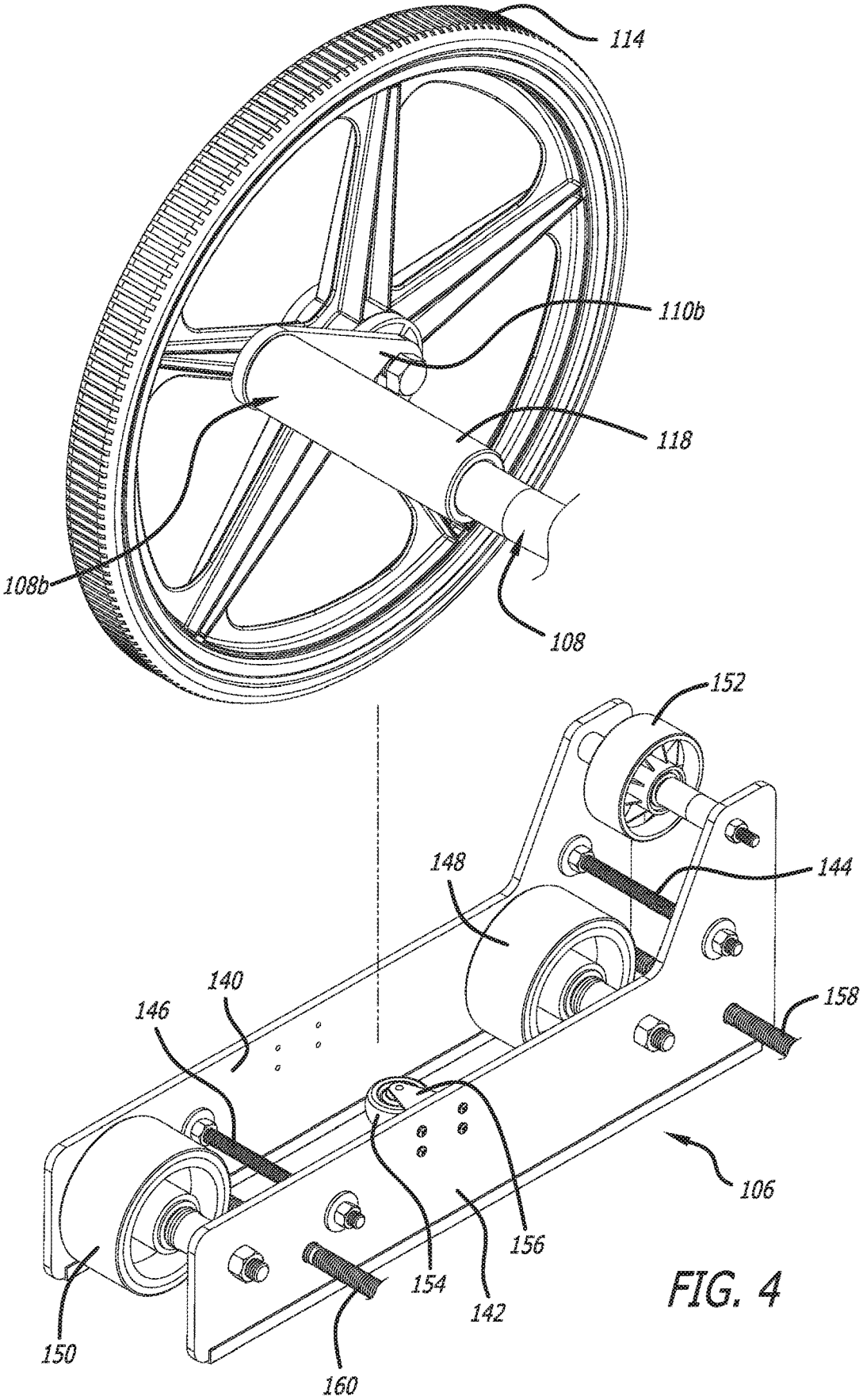
FIG. 4 illustrates a partial exploded view of a wheel and a rolling block of the muscle strengthening system of the present disclosure.
Figure 5:
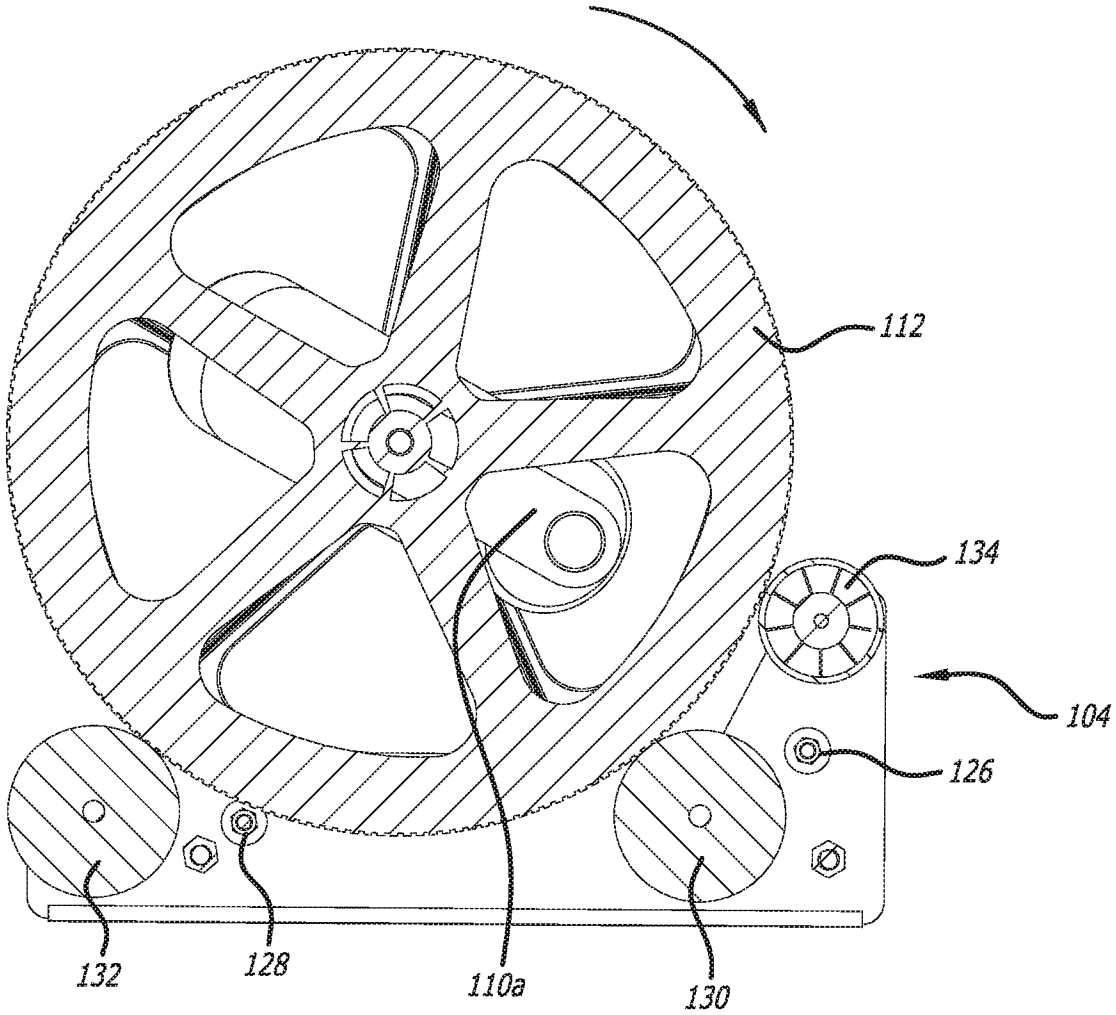
FIG. 5 is a cross sectional view of the muscle strengthening system taken along line 5-5 of FIG. 3.
Figure 8:
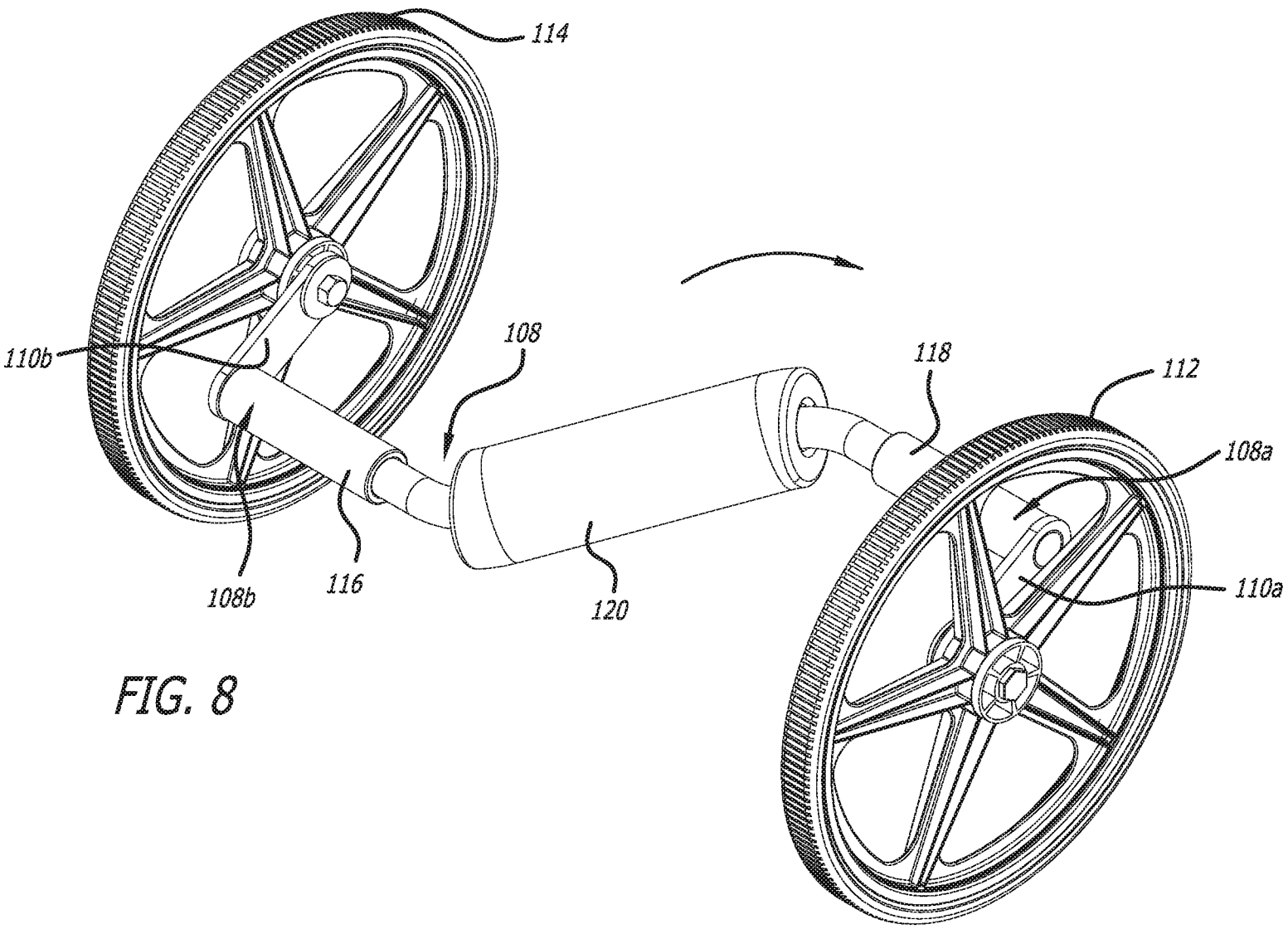
FIG. 8 illustrates the functional core endurance training device of the muscle strengthening system of the present disclosure.
Figure 9:
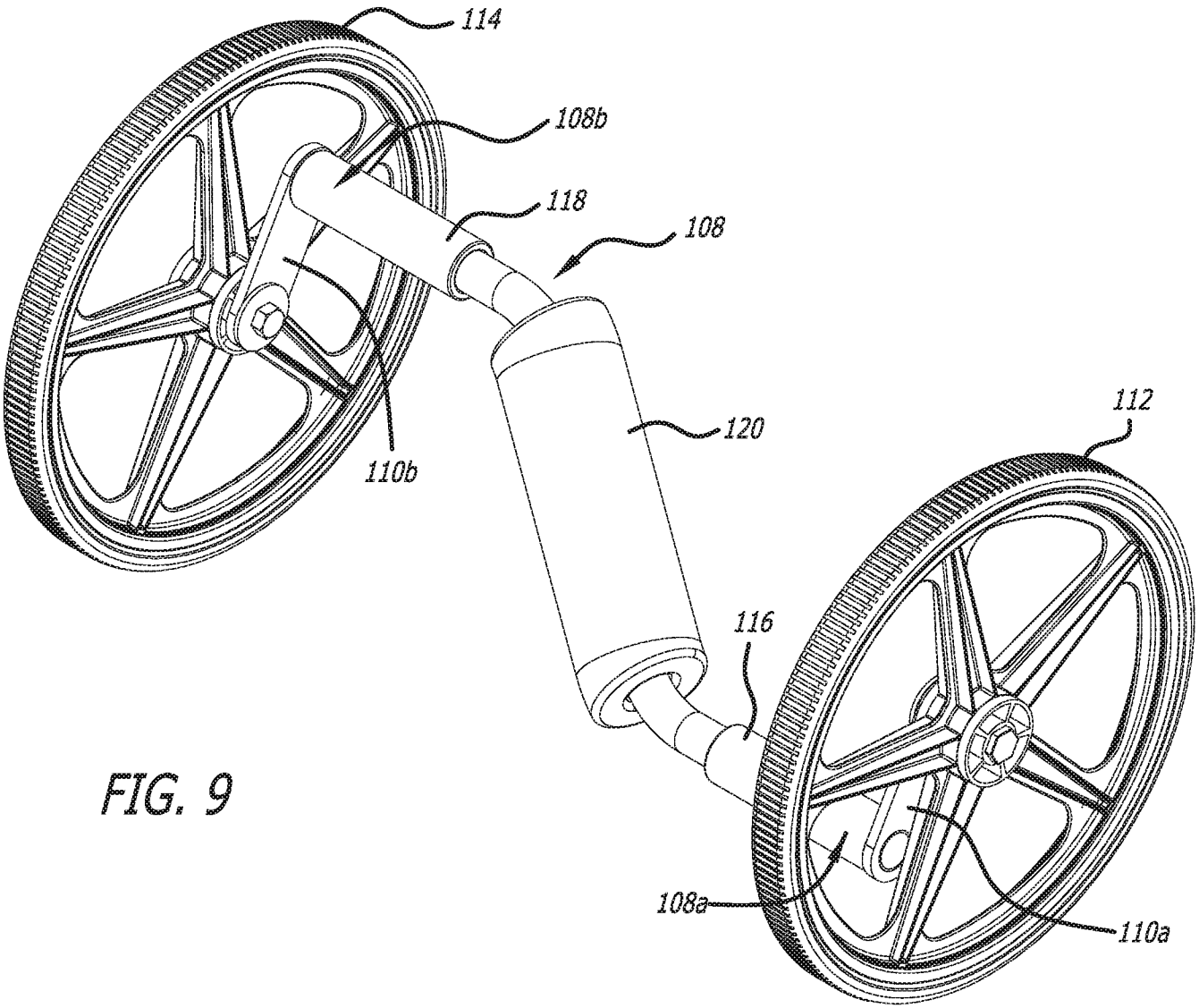
FIG. 9 illustrates the functional core endurance training device of FIG. 8 rotated 180 degrees in a clock-wise direction.

FIG. 1 illustrates a right rear perspective view of the muscle strengthening system 100 of the present disclosure. FIG. 2 illustrates a left front perspective view of the muscle strengthening system 100 of the present disclosure. FIG. 3 illustrates a top plan view of the muscle strengthening system 100 of FIG. 1. FIG. 4 illustrates a partial exploded view of the second wheel 114 and the second rolling block 106 of the muscle strengthening system of the present disclosure. FIG. 5 is a cross sectional view of the muscle strengthening system 100 taken along line 5-5 of FIG. 3. FIG. 8 illustrates the functional core endurance training device 102 of the muscle strengthening system 102 of the present disclosure. FIG. 9 illustrates the functional core endurance training device 100 of FIG. 8 rotated 180 degrees in a clock-wise direction. The following discussion refers interchangeably to FIGS. 1-5 and 8-9.

The functional core endurance training device 102 of the muscle strengthening system 100 may remain stationary by placing a pair of wheels 112, 114 of the functional core endurance training device 102 in elongated openings located in a first rolling block 104 and a second rolling block 106 which form the pair of rolling blocks.

As shown, the functional core endurance 102 of the muscle strengthening system 100 may comprise an elongated rotating axle 108, having a first end 108*a* and a second end 108*b*, secured to a first mounting plate 110*a* and a second mounting plate 110*b*, respectively. The first and second mounting plates 110*a*, 110*b* may be removably and rotatably connected to a first wheel 112 and a second wheel 114, respectively. Although wheels are shown, the present disclosure may utilize other objects known in the art that can rotate. The elongated rotating axle 108 may include a first hand grip 116 located at the first end 108*a* of the elongated rotating axle 108 and secured to the first mounting plate 110*a* and a second hand grip 118 located at the second end 108*b* of the elongated rotating axle 108 and secured to the second mounting plate 110*b*. The first hand grip 114 may be located in a first horizontal plane and the second hand grip 116 may be located in a second horizontal plane where the first and second horizontal planes are parallel to each other. That is, the first hand grip 116 may be offset from the second hand grip 118. The first and second hand grips 116, 118 allow the individual to securely place his hands on the elongated rotating axle 108 to prevent slipping and easily rotate the elongated rotating axle 108 causing the first and second wheels 112, 114 to spin. A mid-section shaft may be integrally connected to and located between the first and second hand grips 116, 118 forming the elongated rotating axle 108. The mid-section shaft may be in an angled position. In one example, an axle pad 120 may be secured to the mid-section shaft to protect the sternum and pectoralis muscles of the individual in the event the individual slips or loses his grip and falls onto the mid-section shaft.

Muscle Strengthening System—Rolling Blocks

According to one aspect, when using the muscle strengthening system 100 of the present disclosure, the functional core endurance training device 102 may remain in a stationary position by placing the first and second wheels 112, 114 within a first elongated opening of the first rolling block 104 and a second elongated opening of the second rolling block 106, respectfully.

The first rolling block 104 may comprise a first side panel 122 and a second side panel secured together by a first rod by a first rod 126 located at the distal end of the side panels 122, 124 and a second rod 128 located at the proximal end of the side panels 122, 124. The first side panel 122 may be a mirror image of the second side panel 124 and the first and second rods 126, 128 are rigid and maintain a first elongated opening between the panels 122, 124. The first side panel 122 and the second side panel 124 are equidistant from each other. Although first and second rigid rods 126, 128 are shown, this is by way of example only and the first and second side panels 122, 124 may be separated by plates, all thread or any other device known in the art. In one example, each of the first and second rigid rods may comprise a cable covering surrounding all thread.

A first roller 130 may be located at the distal end of the first elongated opening created by the first and second side panels 122, 124 and a second roller 132 may be located at a proximal end of the first elongated opening created by the first and second side panels 122, 124. Each of the first and second rollers 130, 132 may be grounding surfaces allowing the first wheel 112 to spin with increased intensity while in the first rolling block 104. That is, the grounding surfaces may change the feel and experience of the muscle strengthening device stabilizing the first wheel 112 and reducing the drag providing for a more fluid motion. The first and second rollers 130, 132 are heavy providing for a smooth and powerful or intense circular movement.

A third roller 134 may be located above the first roller 130. According to one embodiment, the first and second rollers 130, 132 may be the same size while the third roller 134 may be smaller than the first and second rollers 130, 132. Additionally, the first and second rollers 130, 132 may be located in the same horizontal plane and the third roller 134 may be located in a different horizontal plane. The third roller 134 may be a bumper guard preventing the first wheel 112 from being displaced vertically from the first rolling block 104. The first rolling block 104 may further include a stabilizer wheel 136 secured to the second side panel 124 of the first rolling block 104 by a bracket 138. The stabilizer wheel 136 may be a roller integrally connected to and extending perpendicularly outward from the second side panel 124 of the first rolling block 104. The stabilizer wheel may balance the axel when the axel is moving laterally and prevent the axle from being displaced horizontally out of the second rolling block 106.

The second rolling block 106 may comprise a first side panel 140 and a second side panel 142 secured together by a first rod 144 located at a distal end of the first and second side panels 140, 142 and a second rod 146 located at the proximal end of the first and second side panels 140, 142. The first side panel 140 may be a mirror image of the second side panel 142 and the first and second rods 144, 146 are rigid and maintain a second elongated opening between the first and second side panels 140, 142. The first side panel 140 and the second side panel 142 are equidistant from each other. Although first and second rigid rods 144, 146 are shown, this is by way of example only and the side panels 140, 142 may be separated by plates, all thread or any other device known in the art. In one example, each of the first and second rigid rods 144, 146 may comprise a cable covering surrounding all thread.

A first roller 148 may be located at a distal end of the second elongated opening created by the first and second side panels 140, 142 and a second roller 150 may be located at a proximal end of the second elongated opening created by the first and second side panels 140, 142. Each of the first and second rollers 148, 150 may be grounding surfaces allowing the second wheel 114 to spin with increased intensity while in the second rolling block 106. That is, the grounding surfaces may change the feel and experience of the muscle strengthening device stabilizing the second wheel 114 and reducing the drag providing for a more fluid motion. The first and second rollers 130, 132 are heavy providing for a smooth and powerful or intense circular movement.

A third roller 152 may be located above the first roller 148. According to one embodiment, the first and second rollers 148, 150 may be the same size while the third roller 152 may be smaller than the first and second rollers 148, 150. Additionally, the first and second rollers 148, 150 may be located in the same horizontal plane and the third roller 152 may be located in a different horizontal plane.

The third roller 152 may be a bumper guard preventing the second wheel 114 from being displaced vertically from the second rolling block 106. The second rolling block 106 may further include a stabilizer wheel 154 secured to the second side panel 140 of the second rolling block 106 by a bracket 156. The stabilizer wheel 154 may be a roller integrally connected to and extending perpendicularly outward from the second side panel 142 of the second rolling block 106.

According to one embodiment, the first and second rolling blocks 104, 106 may be secured together by a first elongated horizontal rod 158. The first elongated horizontal rod 158 may be secured to the first side panel 122 of the first rolling block 104 and extend through the first elongated opening and the second side panel 124 of the first rolling block 104. The same first elongated horizontal rod 158 may continue to extend from the second side panel 124 of the first rolling block 104 to the second panel 142 of the second rolling block 106, through the second panel 142 and the second elongated opening and then secured to the first side panel 140 of the second rolling block 106. The first elongated horizontal rod 158 may be locked to the first and second rolling blocks 104, 106 by bolt couplers located within each of the first and second rolling blocks 104, 106.

According to another embodiment, the first and second rolling blocks 104, 106 may be secured together by a second elongated horizontal rod 160. The second elongated horizontal rod 160 may be secured to the first side panel 122 of the first rolling block 104 and extend through the first elongated opening and the second side panel 124 of the first rolling block 104. The same second elongated horizontal rod 158 may continue to extend from the second side panel 124 of the first rolling block 104 to the second panel 142 of the second rolling block 106, through the second side panel 142 and the second elongated opening and secured to the first side panel 140 of the second rolling block 106. The second elongated horizontal rod 160 may be locked (or secured) to the first and second rolling blocks 104, 106 by bolt couplers located within each of the first and second rolling blocks 104, 106. The bolt coupler securing the first elongated horizontal rod 158 to the first and second rolling blocks 104, 106 are different from the bolt coupler securing the second elongated horizontal rod 160 to the first and second rolling blocks 104, 106. That is, each of the first and second rolling block may contain a pair of bolt couplers within the first and second elongated openings, respectively.

Muscle Strengthening System—Stationary Foot Pedestal

Figure 6:
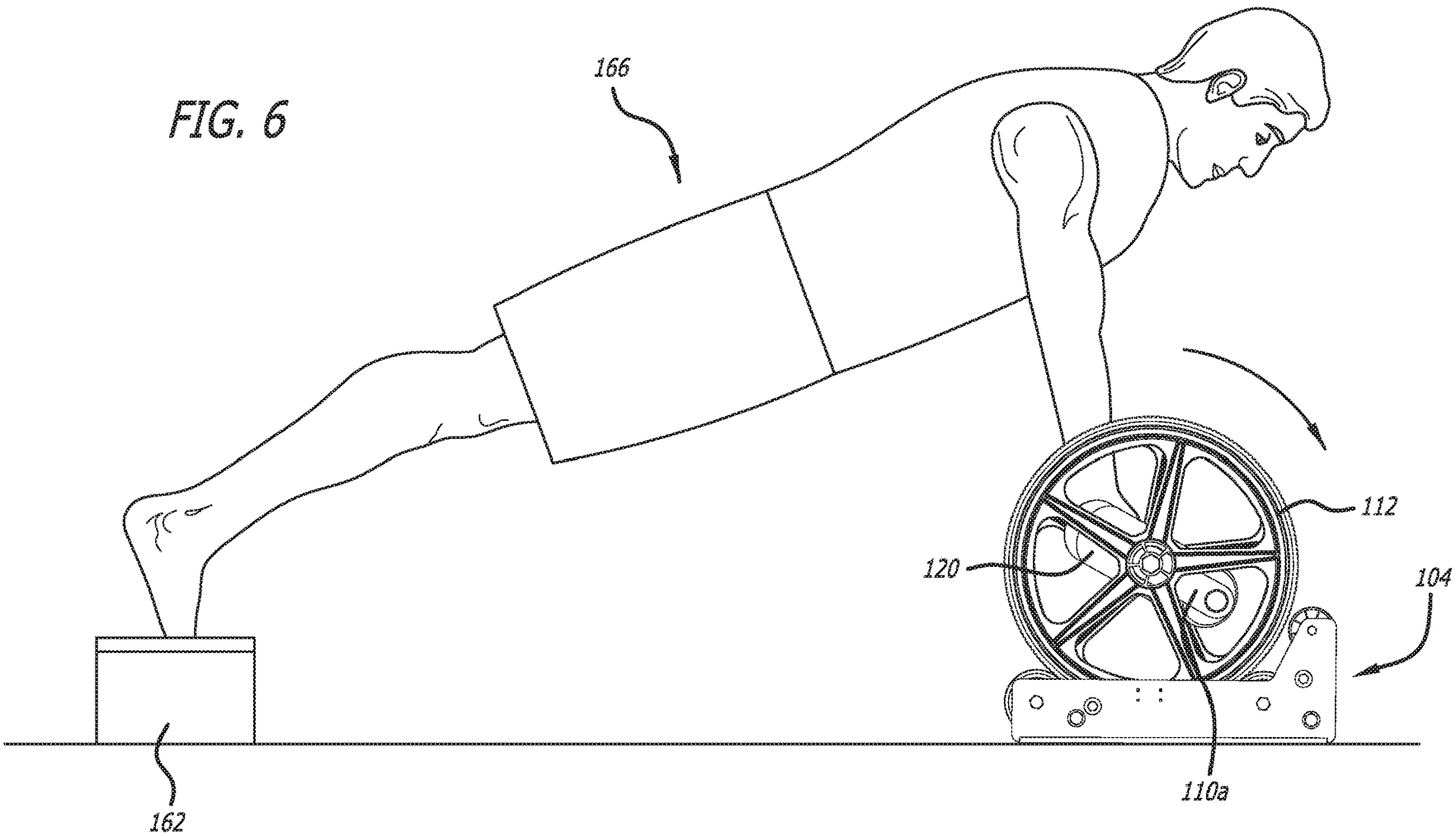
FIG. 6 illustrates an individual utilizing the muscle strengthening system of FIG. 1 with a stationary foot pedestal.
Figure 7:
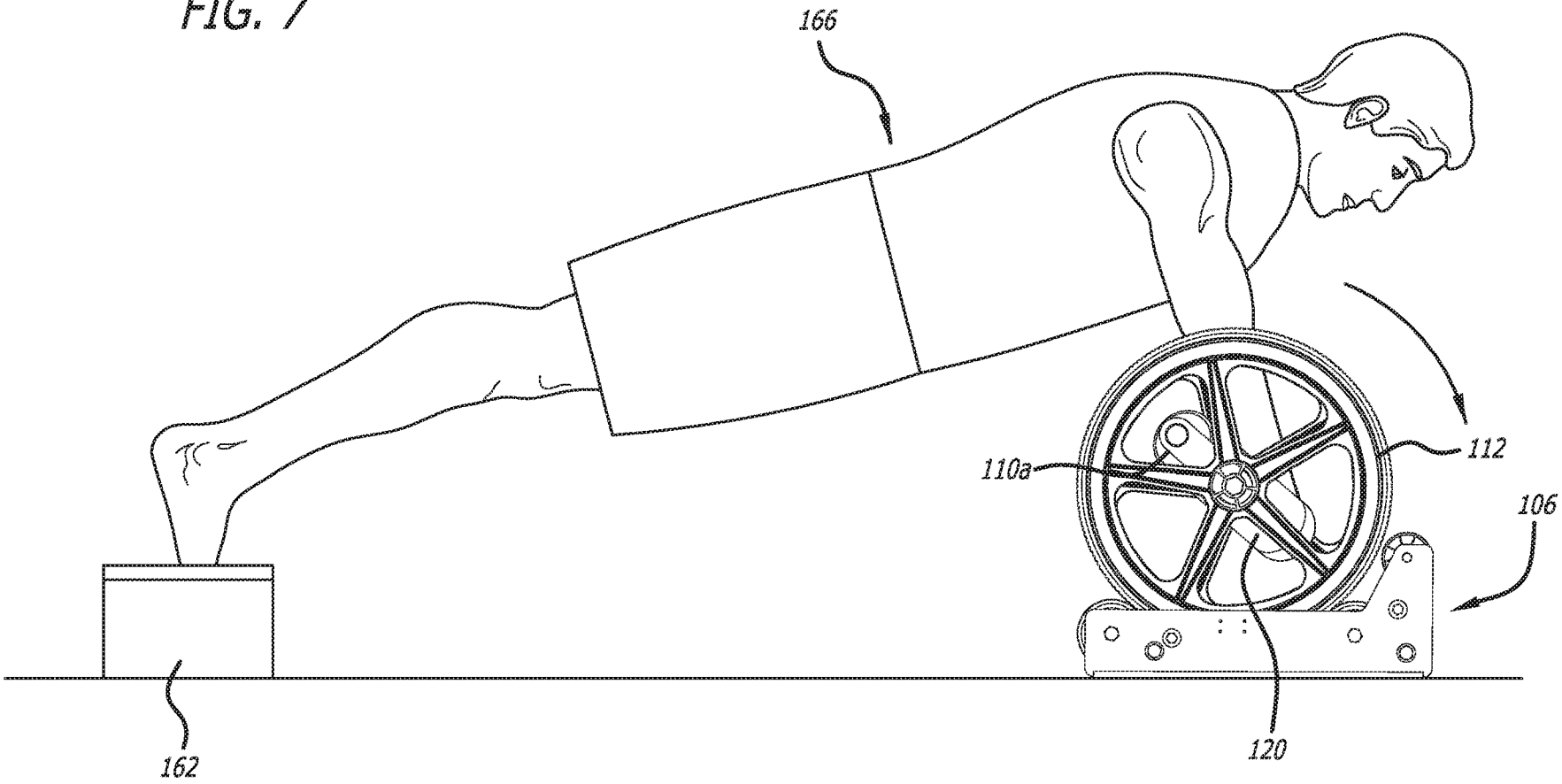
FIG. 7 illustrates the individual of FIG. 6 having rotated the functional core endurance training device 180 degrees.

The muscle strengthening system may be used with a stationary foot pedestal 162 as shown in FIG. 6. When utilizing the stationary foot pedestal 162, the functional core endurance training device 102 remains within the first and second rolling blocks. The individual 166 places his hands on the first and second grips of the axle of the functional core endurance training device 102 while placing his feet on the stationary foot pedestal 162. While in this position, the individual 166 rotates the axle using the first and second hand grips. FIG. 7 illustrates the individual of FIG. 6 having rotated the axle 180 degrees.

Muscle Strengthening System—Wheeled Foot Pedestal

Figure 10:
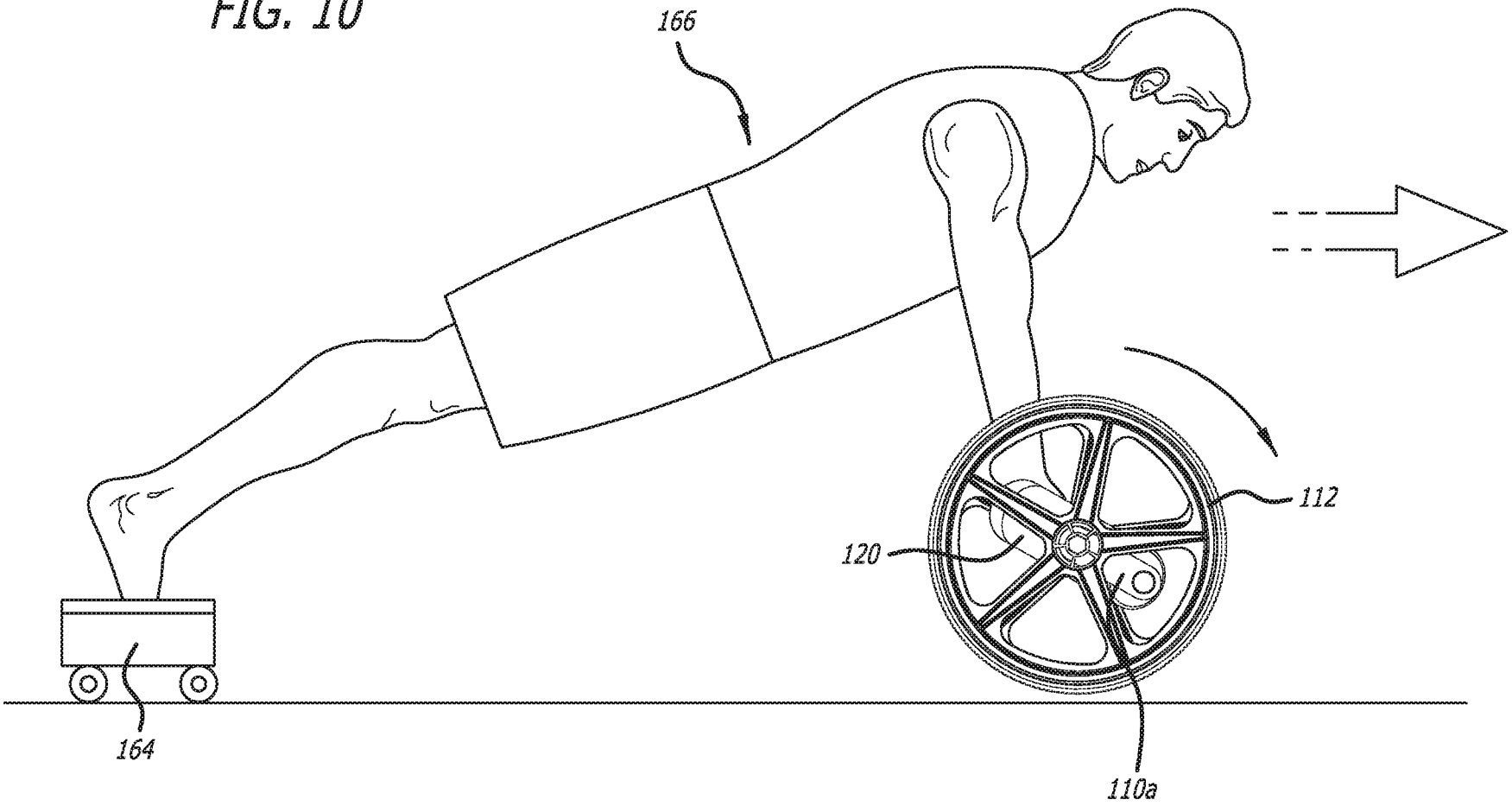
FIG. 10 illustrates an individual utilizing the muscle strengthening system of FIG. 1 with a wheeled foot pedestal.
Figure 11:
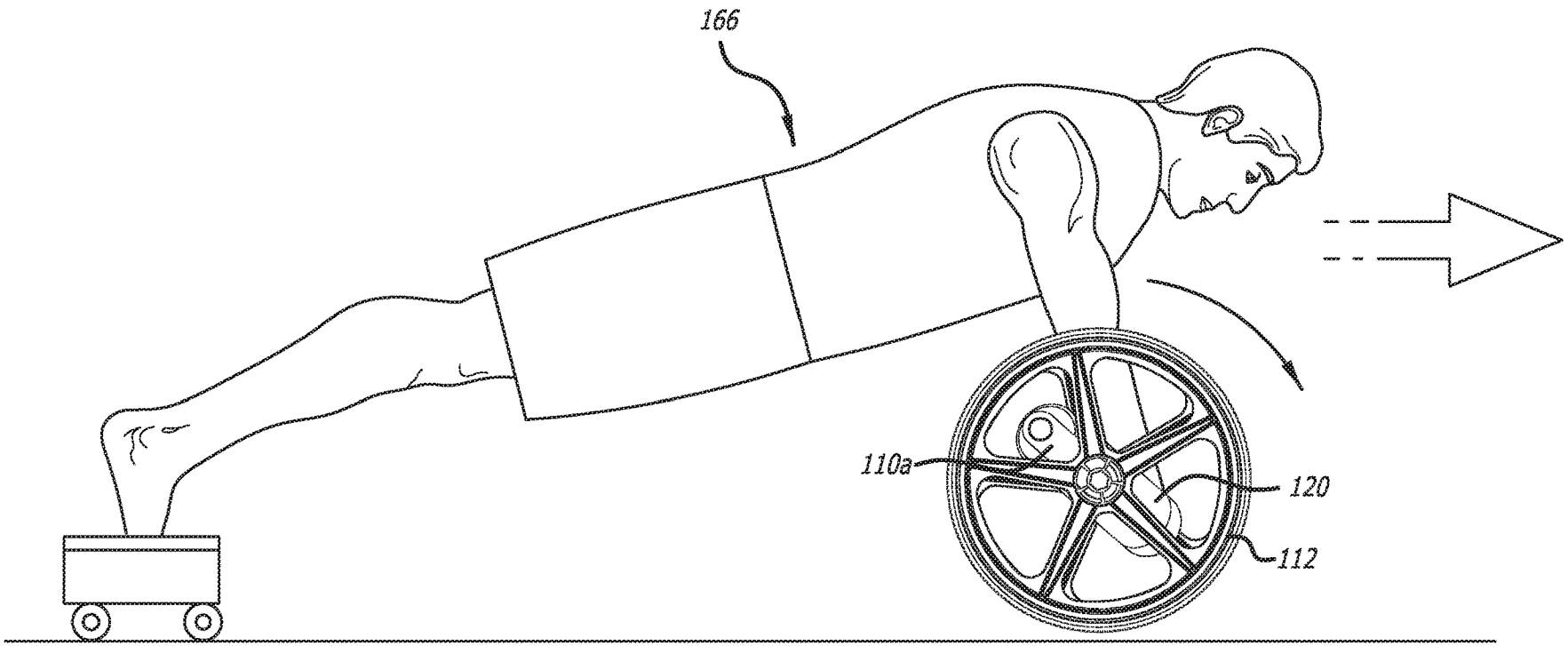
FIG. 11 illustrates the individual in FIG. 10 traveling forward by rotating an axle of the functional core endurance training device while the feet of the individual are placed on the wheeled foot pedestal.

The muscle strengthening system 100 may be used with a wheeled foot pedestal 164 as shown in FIG. 10. The wheeled foot pedestal 164 may include a bottom surface having one or more wheels allowing the wheeled foot pedestal 164 to travel forward or backward. When utilizing the wheeled foot pedestal 164, the functional core endurance training device 102 is removed from the first and second rolling blocks 104, 106. The individual 166 places his hands on the first and second grips of the axle of the functional core endurance training device 102 while placing his feet on a flat top surface of the wheeled foot pedestal 164. While in this position, the individual 166 rotates the axle using the first and second hand grips causing the axle to rotate and consequently the first and second wheels 112, 114 to rotate allowing the user to move forward.

The wheeled foot pedestal 164 provides for an unstable environment causing the individual 166 to use his core to balance himself on the wheeled foot pedestal 164 as well as stabilize the wheeled foot pedestal 164 which requires core strength.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

Accordingly, the various features associate with the examples described herein and shown in the accompanying drawings can be implemented in different examples and implementations without departing from the scope of the disclosure. Therefore, although certain specific constructions and arrangements have been described and shown in the accompanying drawings, such implementations are merely illustrative and not restrictive of the scope of the disclosure, since various other additions and modifications to, and deletions from, the described implementations will be apparent to one of ordinary skill in the art. Thus, the scope of the disclosure is only determined by the literal language, and legal equivalents, of the claims which follow.

What is claimed is:

1. A system for strengthening muscles of an individual, comprising:

a first rolling block having a first elongated opening, the first rolling block comprising:

a first side panel;

a second side panel, the second side panel secured to the first side panel by a first panel rod at a distal end of the first and second side panels and a second panel rod secured at a proximal end of the first and second side panels; and wherein the first and second panel rods maintain the first side panel equidistant from the second side panel;

wherein the first rolling block further comprises a first stabilizing wheel connected to and extending perpendicularly outward from the second side panel; and a second rolling block having a second elongated opening, the second rolling block secured to the first rolling block by a first elongated horizontal rod and a second elongated horizontal rod;

a functional core endurance training device, comprising:

an elongated rotating axle having a first hand grip and a second hand grip separated by a mid-section shaft;

a first wheel rotatably secured to the first hand grip and received in the first elongated opening; and a second wheel rotatably secured to the second hand grip and received in the second elongated opening.

2. The system of claim 1, wherein the first rolling block further comprises a first roller located in the distal end of the first elongated opening of the first rolling block, the first roller having a first grounding surface.

3. The system of claim 2, wherein the first rolling block further comprises a second roller located in the proximal end of the second elongated opening of the second rolling block having a second grounding surface.

4. The system of claim 2, wherein the first rolling block further comprises a third roller located in the distal end of the first elongated opening above the second roller.

5. The system of claim 1, wherein the second rolling block comprises:

a third side panel;

a fourth side panel, the fourth side panel secured to the third side panel by a third panel rod at a distal end of the third and fourth side panels and a fourth panel rod secured at a proximal end of the third and fourth side panels; and wherein the third and fourth panel rods maintain the third side panel equidistant from the fourth side panel.

6. The system of claim 5, wherein the second rolling block further comprises a first roller located in the distal end of the second elongated opening of the second rolling block, the first roller having a first grounding surface.

7. The system of claim 6, wherein the second rolling block further comprises a second roller located in the proximal end of the second elongated opening of the second rolling block having a second grounding surface.

8. A system for strengthening muscles of an individual, comprising:

a first rolling block having a first elongated opening, the first rolling block comprising:

a first side panel;

a second side panel, the second side panel secured to the first side panel by a first panel rod at a distal end of the first and second side panels and a second panel rod secured at a proximal end of the first and second side panels; and wherein the first and second panel rods maintain the first side panel equidistant from the second side panel;

wherein the first rolling block further comprises a first stabilizing wheel connected to and extending perpendicularly outward from the second side panel; and a second rolling block having a second elongated opening, the second rolling block secured to the first rolling block by a first elongated horizontal rod and a second elongated horizontal rod;

and a functional core endurance training device, comprising:

an elongated rotating axle having a first hand grip and a second hand;

a first wheel rotatably secured to the first hand grip and received in the first elongated opening;

and a second wheel rotatably secured to the second hand grip and received in the second elongated opening.

9. The system of claim 8, wherein the second rolling block comprises:

a third side panel;

a fourth side panel, the fourth side panel secured to the third side panel by a third panel rod at a distal end of the third and fourth side panels and a fourth panel rod secured at a proximal end of the third and fourth side panels; and wherein the third and fourth panel rods maintain the third side panel equidistant from the fourth side panel.

10. The system of claim 8, wherein the first rolling block further comprises a first roller located in the distal end of the first elongated opening of the first rolling block, the first roller having a first grounding surface.

11. The system of claim 10, wherein the first rolling block further comprises a second roller located in the proximal end of the second elongated opening of the second rolling block having a second grounding surface.

12. The system of claim 11, wherein the first rolling block further comprises a third roller located in the distal end of the first elongated opening above the second roller.

13. The system of claim 8, wherein the second rolling block further comprises a first roller located in the distal end of the second elongated opening of the second rolling block, the first roller having a first grounding surface.

14. The system of claim 13, wherein the second rolling block further comprises a second roller located in the proximal end of the second elongated opening of the second rolling block having a second grounding surface.

* * * * *